US010144577B1

(12) United States Patent
Cheke et al.

(10) Patent No.: US 10,144,577 B1
(45) Date of Patent: Dec. 4, 2018

(54) SUPPORT WEDGE AND RELATED ASSEMBLIES

(71) Applicant: Thermoseal Industries, LLC, Gloucester City, NJ (US)

(72) Inventors: Donald B. Cheke, Saskatoon (CA); Richard A. Chubb, Voorhees, NJ (US)

(73) Assignee: THERMOSEAL INDUSTRIES, LLC, Gloucester City, NJ (US)

( * ) Notice: Subject to any disclaimer, the term of this patent is extended or adjusted under 35 U.S.C. 154(b) by 0 days.

(21) Appl. No.: 15/607,847

(22) Filed: May 30, 2017

(51) Int. Cl.
*B65D 85/48* (2006.01)
*A47F 7/00* (2006.01)

(52) U.S. Cl.
CPC ..... *B65D 85/48* (2013.01); *A47F 7/0042* (2013.01)

(58) Field of Classification Search
CPC ..... B65D 85/48; B65D 19/12; B65D 19/385; B65D 19/42; B65D 19/44; B65D 2519/00019; B65D 2519/00029; B65D 2519/00059; B65D 2519/00164; B65D 2519/00184; B65D 2519/00288; B65D 2519/00303; B65D 2519/00323; B65D 2519/00333; B65D 2519/00338; B65D 2519/00348; B65D 2519/00373; B65D 2519/00512; B65D 2519/00532; B65D 2519/00557; B65D 2519/00562; B65D 2519/00631; B65D 2519/00666; B65D 2519/00815; B65D 2519/00995; A47F 7/0042
USPC ..... 211/41.14, 41.15, 41.16; 206/448, 449, 206/451, 454; 53/447
See application file for complete search history.

(56) References Cited

U.S. PATENT DOCUMENTS

| | | | |
|---|---|---|---|
| 3,848,917 | A | 11/1974 | O'Neal |
| 3,878,942 | A | 4/1975 | Hansen et al. |
| 4,278,171 | A | 7/1981 | Millhoan |
| 4,934,538 | A | 6/1990 | Beyer |
| 5,246,121 | A | 9/1993 | Mitake et al. |
| 6,102,206 | A | 8/2000 | Pride |
| 6,386,376 | B1 | 5/2002 | Mendoza-Castillo et al. |
| 6,742,663 | B2 | 6/2004 | Chubb |

*Primary Examiner* — Ko H Chan
(74) *Attorney, Agent, or Firm* — Fredrikson & Byron, P.A.

(57) ABSTRACT

Embodiments of devices, assemblies, and related methods for transporting glass panels, such as doors, are disclosed. One embodiment of a rack assembly includes a support rack and a first support wedge positioned at the support rack. The first support wedge includes a first end and a second end opposite the first end. The first support wedge further includes a first surface extending between the first end and the second end as well as a second surface extending between the first end and the second end opposite the first surface. The second surface defines a plurality of support platform pairs. Each support platform pair includes a first platform at a first elevation relative to the first surface and a second platform at a second elevation relative to the first surface. The second elevation is different than the first elevation.

20 Claims, 4 Drawing Sheets

SUPPORT WEDGE AND RELATED ASSEMBLIES

TECHNICAL FIELD

This disclosure relates generally to devices, assemblies, and related methods for transport packing of glass panels, such as doors.

BACKGROUND

Glass panels, such as doors, are generally manufactured at one location and then shipped to another location where they are installed. Such glass units can be fragile and require that precautions be taken during shipping to reduce the risk of breaking the units. This often can result in increasing a spatial footprint associated with the glass units, for instance, due to the use of additional protective components. However, at the same time, cost pressures tend to encourage that as many glass units as possible be included within a shipping space (e.g., a trailer). Accordingly, it can be challenging to both securely and cost-effectively transport glass units.

SUMMARY

In general, embodiments disclosed herein provide devices, assemblies, and related methods that can be useful in facilitating both secure and cost-effective transport packaging of glass units, such as doors. For instance, in cases where doors to be shipped include handles, embodiments disclosed herein can offset these doors in a manner that efficiently uses space while at the same time reduces incidents of damage to the doors (e.g., caused by the handles). As one example, embodiments disclosed herein can position the doors such that the respective handles nest over/under an adjacent door. Certain embodiments can further dispose the doors at an angle that may prevent movement of the doors in one or more directions having the potential to damage the doors.

One exemplary embodiment includes a rack assembly. The rack assembly has a support rack and a first support wedge positioned at the support rack. The first support wedge includes a first end and a second end opposite the first end. The first support wedge further includes a first surface extending between the first end and the second end as well as a second surface extending between the first end and the second end opposite the first surface. The second surface defines a plurality of support platform pairs. Each support platform pair includes a first platform at a first elevation relative to the first surface and a second platform at a second elevation relative to the first surface. The second elevation is different than (e.g., greater than) the first elevation. In a further embodiment, the rack support includes a base on which the first support wedge is positioned as well as a backing brace secured to the base. The backing brace can be positioned at an angle between ninety and one hundred and thirty five degrees relative to the base. The angle at which the backing brace is positioned can be substantially equal to the angle at which the first end and/or the second end of the first support wedge is positioned relative to the first surface. In this way, the first end and/or the second end of the support wedge can sit flush against the backing brace. In some examples, the rack assembly can further include a plurality of doors seated on the first support wedge.

Another exemplary embodiment includes a support wedge. The support wedge has a first end and a second end opposite the first end. The support wedge further has a first surface extending between the first end and the second end as well as a second surface extending between the first end and the second end opposite the first surface. A plurality of support platform pairs are defined on the second surface. Each support platform pair includes a first platform at a first elevation relative to the first surface and a second platform at a second greater elevation relative to the first surface.

Additional exemplary embodiments can include methods of loading a plurality of doors onto a rack support. In one such exemplary embodiment, a first door and a second door are seated at a first support platform pair of a first support wedge that is positioned on the rack support. The first door is seated at a first platform of the first support platform pair at a first elevation relative to a first surface of the first support wedge. The second door is seated at a second platform of the first support platform pair at a second, greater elevation relative to the first surface of the first support wedge. A second support wedge is positioned on the first door and the second door at respective ends of the first door and the second door opposite the first support wedge. A second platform of a second support platform pair of the second support wedge is positioned on the first door and a first platform of the second support platform pair is positioned on the second door. The second platform of the second support platform pair is at a greater elevation than the first platform of the second support platform pair relative to a first surface of the second support wedge. In a further exemplary embodiment, a securing member, such as a strap or band, is placed around the first door and the second door over the second support wedge.

The details of one or more examples are set forth in the accompanying drawings and the description below. Other features, objects, and advantages will be apparent from the description and drawings, and from the claims.

BRIEF DESCRIPTION OF DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

FIG. 4 is shown with a number of exemplary dimensions included for exemplary non-limiting, illustrative purposes only.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, and/or dimensions are provided for selected elements. Those skilled in the art will recognize that many of the noted examples have a variety of suitable alternatives.

Figure 1:
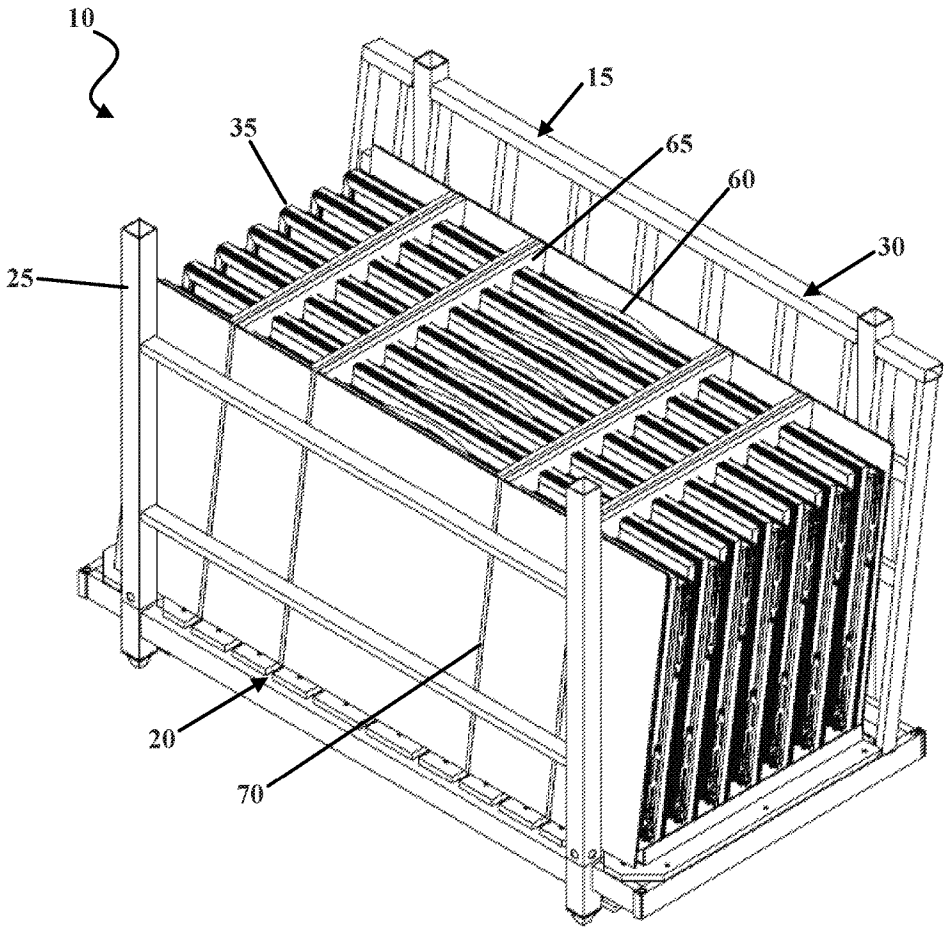
FIG. 1 is a perspective view of an exemplary embodiment of a rack assembly.
Figure 2:
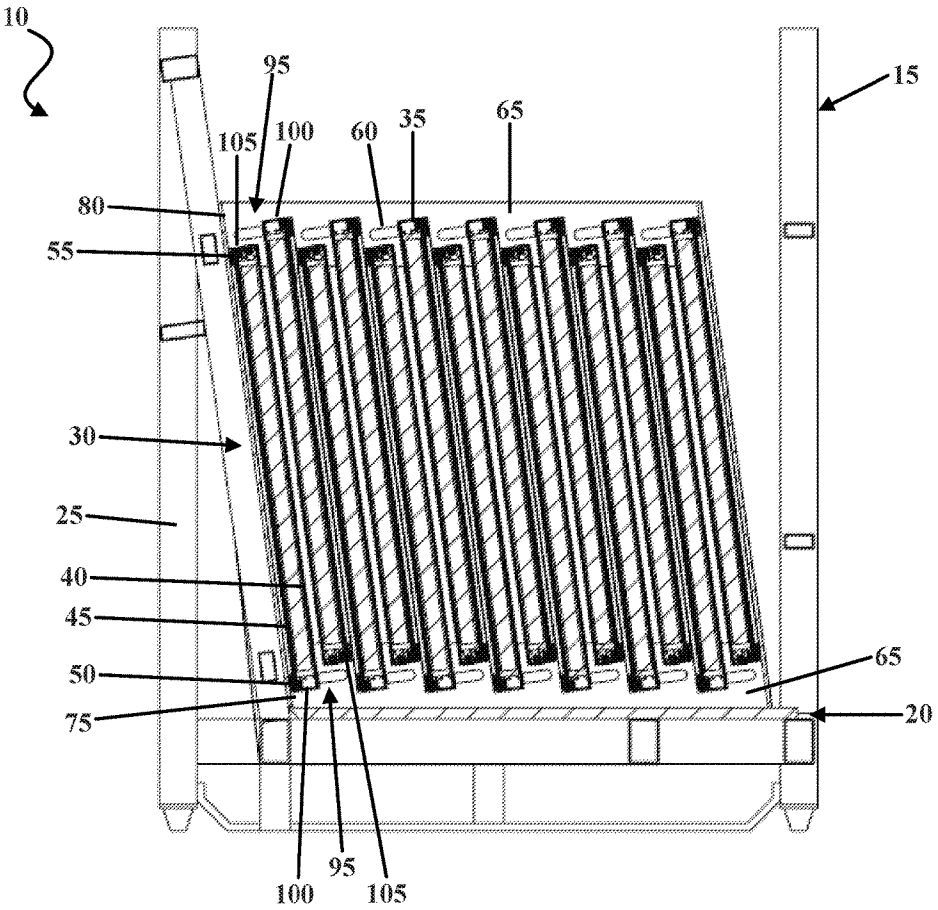
FIG. 2 is a cross-sectional view of the rack assembly in FIG. 1, taken through the center of the rack assembly in FIG. 1.

FIGS. 1 and 2 illustrate an exemplary embodiment of a rack assembly 10. FIG. 1 shows a perspective view of the rack assembly 10. FIG. 2 shows a cross-sectional view of the rack assembly 10 taken through the center of the rack assembly in FIG. 1. The rack assembly 10 can be useful, for example, in packaging a plurality of glass units for transport and/or storage. The types of glass units transported and/or stored using the rack assembly 10 can vary depending on the specific application of the rack assembly 10. For instance, such glass units could include doors (e.g., multi-pane insulated refrigerator or freezer doors with handles) or window units. In some cases, a number of rack assemblies 10 can be loaded into a shipping space (e.g., a trailer) and positioned therein adjacent one another and/or stacked on top of one another.

In the illustrated example, the rack assembly 10 includes a support rack 15. The support rack 15 includes a base 20, a number of vertical support members 25, and a backing brace 30. The vertical support members 25 extend up generally perpendicular to the base 20. In some embodiments, respective ends of the vertical support members 25 that are opposite the base 20 can be configured to receive respective ends of vertical support members of another support rack. As such, two distinct support racks can be stacked vertically when appropriate. The backing brace 30 can be secured to the base 20 at one end and extend upward from the base 20 to one or more vertical support members 25 at which another opposite end of the backing brace 30 can be secured. The backing brace 30 can extend up from the base 20 at an angle. As shown in the illustrated example, the backing brace 30 can be positioned at an obtuse angle relative to the base 20. In a particular embodiment, the backing brace 30 can be positioned at an angle between ninety and one hundred and thirty five degrees relative to the base 20. In another particular embodiment, the backing brace 30 can be positioned at an angle between ninety and one hundred and ten degrees relative to the base 20.

In addition, the illustrated example of the rack assembly 10 includes a plurality of doors 35 (e.g., fourteen doors are shown in this exemplary embodiment). As noted previously, in other examples, the rack assembly 10 could include various other types of glass units. Each of the doors 35 in this example includes a front side 40, a rear side 45, a first end 50, and a second opposite end 55. The front side 40 of each door 35 can include a handle 60 that protrudes out from the front side 40. The first end 50 and second end 55, in the illustrated embodiment, are stile ends of each door 35. Thus, the doors 35 can be laid along the base 20 horizontally (e.g., ninety degrees off of a typical installation orientation). Here, the handle 60 is shown protruding out from the front side 40 at the first end 50 of each door 35.

As best seen in the example of FIG. 2, the doors 35 are arranged in an alternating fashion. The first door 35 on the left end in FIG. 2 has its rear side 45 interfacing with the backing brace 30 (e.g., the side of the first door 35 on the left opposite the handle 60 interfacing with the backing brace 30). In some examples, the rear side 45 of the first door 35 on the left can directly contact the backing brace 30 while in other examples a protective layer (e.g., a cardboard sheet) can be disposed between the rear side 45 of the first door 35 can the backing brace 30. The first door 35 on the left then has its front side 40 interfacing with the front side 40 of the second door 35 from the left (e.g., the handle 60 sides of the door 35 on the left and the second door 35 from the left interface). The second door 35 from the left then has its rear side 45 interfacing with the rear side 45 of the third door 35 from the left. Thus, the doors 35 are arranged in front side 40 interfacing pairs (e.g., handle 60 side interfacing pairs). In addition, as also best seen in the example of FIG. 2, the doors 35 alternate such that the first end 50 of the first door 35 on the left interfaces with the second end 55 of the second door 35 from the left near the base 20 while the second end 55 of the first door 35 on the left interfaces with the first end 50 of the second door 35 from the left opposite the base 20. Other pairs of doors 35 can be similarly arranged in this orientation. In this way, the handles 60 of the pairs of doors 35 are able to nest over/under the adjacent door 35 of the pair.

In the illustrated example, the rack assembly 10 further includes a number of support wedges 65. The plurality of doors 35 are seated on the support wedges 65. As best seen in the example of FIG. 2, one support wedge 65 is positioned at the support rack 15 and, more specifically, this support wedge 65 is positioned on the base 20. The support wedges 65 can, for instance, serve to secure the doors 35 in place at the support rack 15. The support wedges 65 can also, for instance, serve to orient the doors 35 in the alternating fashion described previously such that the handles 60 nest over/under the adjacent door 35. Furthermore, the support wedges 65 may be configured so as to angle the doors 35 to a degree that lays the doors 35 substantially flush against the backing brace 30. This can help, for example, to prevent one or more doors 35 from falling forward when unloading other doors 35 of the assembly.

The support wedges 65 can be made of a variety of appropriate materials. As one example, the support wedges 65 can be made, at least in part, of a polyethylene foam material. This can be useful, for instance, in helping to preserve the integrity of the support wedges 65 for reuse over a number of cycles. As another example, the support wedges 65 can be made, at least in part, of a cardboard-type material. In this example, the cardboard may be fluted and/or include a honeycomb structure to help increase the load bearing capability in a particular loading direction relative to the support wedges 65. This can be useful, for instance, where the support wedges are intended for a single use application. Other materials can be used, alternatively or in addition to, those described here as appropriate for particular applications of the support wedges 65 (e.g., depending on the glass units being used).

In the illustrated embodiment, a number of support wedges 65 are positioned along opposite ends of the doors 35. Namely, a number of support wedges 65 (e.g., four support wedges 65) are positioned between the doors 35 and the base 20 along what could be referred to as a "bottom" portion of the rack assembly 10. And, a number of support wedges 65 (e.g., four support wedges 65) are positioned on the doors 35 at an end opposite the base 20 along what could be referred to as a "top" portion of the rack assembly 10. In this example, the number of support wedges 65 positioned along the bottom portion and the number of support wedges 65 positioned along the top portion are each spaced from the portion of the doors 35 where the handle 60 is located. As seen in FIG. 1, two support wedges 65 are spaced from the handles 60 at one side along the top portion and two support wedges 65 are spaced from the handles 60 at another side along the top portion. The same arrangement can be present along the bottom portion as well.

In addition to the securing and orientation functions served by the support wedges 65, one or more support wedges 65 can serve as a location where one or more securing members 70 are placed. The securing member 70 can be, for example, a band, strap, or other appropriate member useful for holding the doors 35 at the support rack 15. As seen in FIG. 1, the securing member 70 can be placed over the surface of the support wedge 65 that is opposite the surface of the support wedge 65 at which the doors 35 are seated. In this way, the securing member 70 may be prevented from wearing on the doors 35. In some cases, the securing member 70 can also be arranged at the base 20 so that the securing member 70 holds the doors 35 at the support rack 15.

Figure 3:
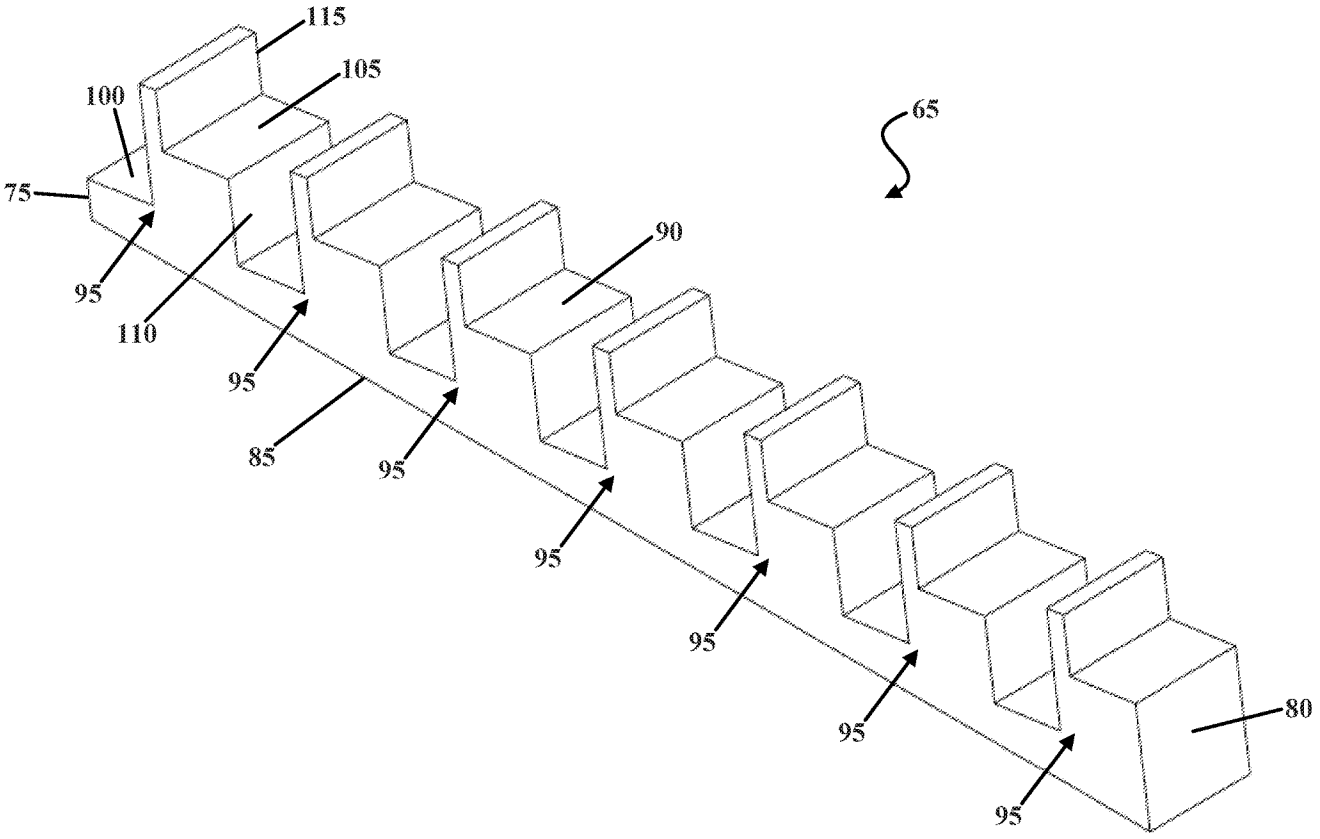
FIG. 3 is a perspective view of an exemplary embodiment of a support wedge.
Figure 4:
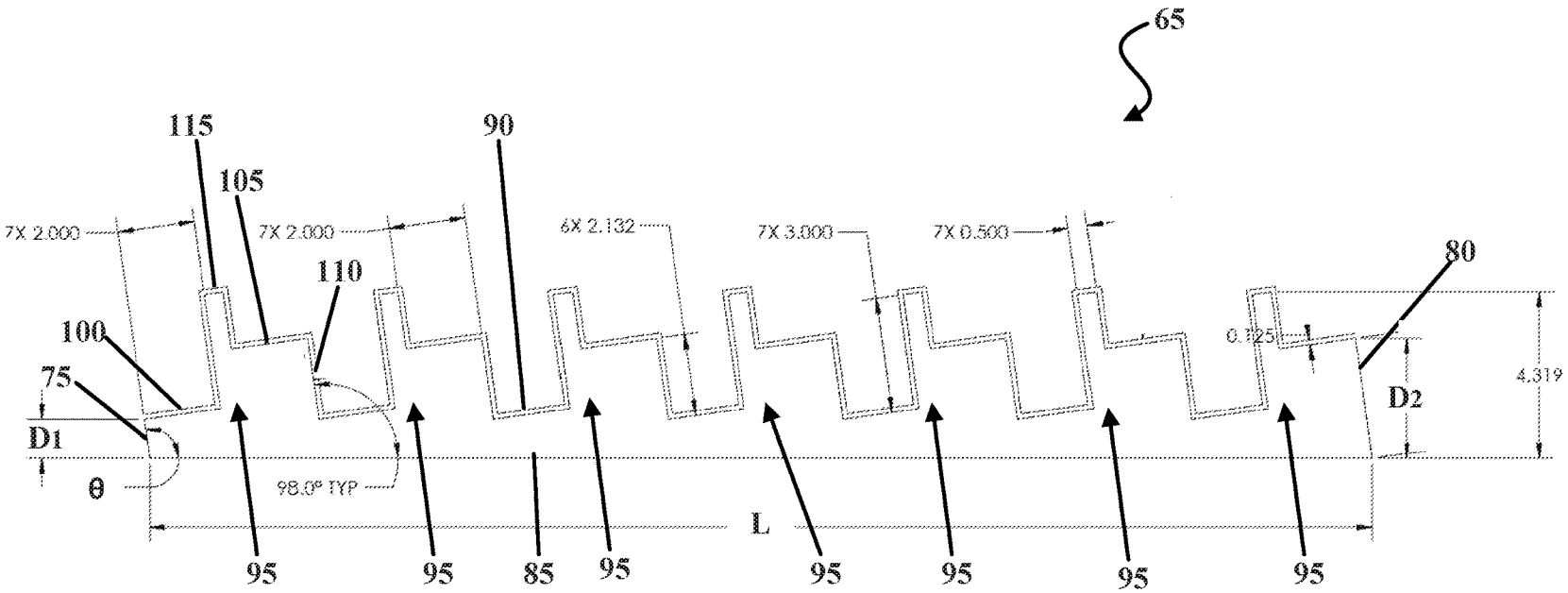
FIG. 4 is a side elevational view of the support wedge in FIG. 3.

Having described exemplary rack assembly embodiments, details of the support wedge 65 will now be described. FIGS. 3 and 4 illustrate an exemplary embodiment of the support wedge 65. FIG. 3 shows a perspective view of the support wedge 65. FIG. 4 shows a side elevational view of the support wedge 65. Solely for non-limiting purposes and in furtherance of the illustration of one particular example, FIG. 4 is shown with a number of exemplary dimensions.

The illustrated exemplary support wedge 65 includes a first end 75 and a second end 80. The second end 80 is opposite the first end 75. The support wedge 65 further includes a first surface 85 extending between the first end 75 and the second end 80 and a second surface 90 extending between the first end 75 and the second end 80. The second surface 90 is opposite the first surface 85. The first surface 85 lies along a common elevation, while the second surface 90 has portions of varying elevations. The first end 75 extends a first distance $D_1$ between the first surface 85 and the second surface 90 and the second end 80 extends a second distance $D_2$ between the first surface 85 and the second surface 90. In the embodiment shown here, the second distance $D_2$ is greater than the first distance $D_1$. The first end 75 extends between the first surface 85 and the second surface 90 at an angle θ measured relative to the first surface 85. The angle θ can be, for instance, an obtuse angle. In one such example, the angle θ can be between ninety and one hundred and thirty five degrees relative to the first surface 85. In another such example, the angle θ can be between ninety and one hundred and ten degrees relative to the first surface 85. In some embodiments, the angle θ can be equal to the angle that the backing brace is positioned at relative to the base. In such embodiments, the first end 75 can thus sit substantially flush with the backing brace when positioned at the support rack. In one additional or alternative embodiment, the second end 80 extends between the first surface 85 and the second surface 90 at an angle equal to the angle θ relative to the first surface 85. In such an embodiment, the second end 80 can thus sit substantially flush with the backing brace when positioned at the support rack.

The second surface 90 can define a plurality of support platform pairs 95. Each support platform pair 95 may include a first platform 100 and a second platform 105. The first platform 100 can be at a first elevation relative to the first surface 85 and the second platform 105 can be at a second, different elevation relative to the first surface 85. As shown here, the second elevation of the second platform 105 is greater than the first elevation of the first platform 100. In the illustrated example, the first platform 100 and second platform 105 of each support platform pair 95 are disposed at angle relative to the first surface 85. The angle at which the first platform 100 and second platform 105 of each support platform pair 95 is disposed relative to the first surface 85 can be equal to the angle θ at which the first end 75 extends relative to the first surface 85.

The plurality of support platform pairs 95 can be spaced from one another along a length L of the first surface 85. As one example, a first support platform pair 95 at the left end of the support wedge 65 in FIG. 4 is adjacent to a second support platform pair 95 that is second from the left of the support wedge 65 in FIG. 4. In this example, the second platform 105 of the first support platform pair 95 is adjacent the first platform 100 of the second support platform pair 95. Here, the second platform 105 of the first support platform pair 95 is connected to the first platform 100 of the second support platform pair 95 by a portion 110 of the second surface 90. The connecting portion 110 of the second surface 90 can extend at an angle of ninety degrees relative to the first platform 100 of the second support platform pair 95 between the second platform 105 of the first support platform pair 95 and the first platform 100 of the second support platform pair 95. As another example, a first support platform pair 95 can be at the left end of the support wedge 65 in FIG. 4 and a second support platform pair 95 can be at a right end of the support wedge 65 in FIG. 4. In this example, the first end 75 extends from the first surface 85 to the second surface 90 at the first platform 100 of the first platform pair 95. In addition, in this example, the second end 80 extends from the first surface 85 to the second surface 90 at the second platform 105 of the second support platform pair 95. In this way, the first platform 100 is at the first end 75 while the second platform 105 is at the second end 80.

In some embodiments, like that shown, each support platform pair 95 further includes a wall 115. The wall 115 can be located between the first platform 100 and the second platform 105. The wall 115 can extend out to an elevation relative to the first surface 85. The elevation of the wall 115 relative to the first surface 85 can be greater than the second elevation of the second platform 105 and/or the first elevation of the first platform 100. The wall 115 can be useful in preventing adjacent doors at the first and second platforms 100, 105 from coming into contact, particularly where support wedges 65 are positioned along both the top and bottom portions of the rack assembly. The wall 115, in some cases, can extend out at an angle of ninety degrees relative to the second platform 105. In one example, the wall 115 can be of a length along the second surface 90 that is less than a length of the first platform 100 and/or the second platform 105 along the second surface 90.

As discussed previously in connection with the example shown in FIGS. 1 and 2, one or more support wedges 65 can be included in the rack assembly and the plurality of doors 35 can be seated at the one or more support wedges 65.

Referring back to the example shown in FIG. 2, a first support wedge 65 is shown positioned at the base 20 of the support rack 15. The first end 75 of the first support wedge 65 interfaces with the backing brace 30. As noted, the described respective angles of the first end 75 and the backing brace 30 can allow the first end 75 to interface flush with the backing brace 30. A first, left most, door 35 in FIG. 2 is seated at the first platform 100 of a first support platform pair 95. As shown, the first end 50 of the first door 35, from which the handle 60 protrudes out, is seated at the first platform 100 of the first support platform pair 95. A second door 35, second from the left in FIG. 2, is seated at the second platform 105 of the first support platform pair 95. As shown, the second end 55 of the second door 35, which is opposite the first end 50 having the handle 60, is seated at the second platform 105 of the first support platform pair 95. Additional support wedges 65 can be positioned along the base 20 with a similar arrangement of doors 35 as described here for the first support wedge 65.

Again referring to the example shown in FIG. 2, a second support wedge 65 is shown positioned along the top portion of the rack assembly 10 (e.g., opposite the base 20). The second end 80 of the second support wedge 65 interfaces with the backing brace 30. As noted, the described respective angles of the second end 80 and the backing brace 30 can allow the second end 80 to interface flush with the backing brace 30. The first, left most, door 35 in FIG. 2 is seated at the second platform 105 of a first support platform pair 95 of the second support wedge 65. As shown, the second end 55 of the first door 35, which is opposite the first end 50 having the handle 60, is seated at the second platform 105 of the first support platform pair 95. The second door 35, second from the left in FIG. 2, is seated at the first platform 100 of the first support platform pair 95 of the second support wedge 65. As shown, the first end 50 of the second door 35, from which the handle 60 protrudes out, is seated at the first platform 100 of the first support platform pair 95. Additional support wedges 65 can be positioned along the top portion of the rack assembly 10 with a similar arrangement of doors 35 as described here for the second support wedge 65.

In addition to exemplary assemblies and devices described herein, embodiments can include methods of loading a plurality of doors onto a rack support.

In one such exemplary method embodiment, a first step can include seating a first door and a second door at a first support platform pair of a first support wedge. The first support wedge can be positioned on the rack support, such as at a base of the rack support. This first step can include, in some embodiments, seating the first door at a first platform of the first support platform pair at a first elevation relative to a first surface of the first support wedge. This first step can further include, in some embodiments, seating the second door at a second platform of the first support platform pair at a second, greater elevation relative to the first surface of the first support wedge. In some instances, this step can include seating the first and second doors at the first support wedge such that the respective handles of the first and second doors net over the adjacent door.

A second step can include positioning a second support wedge on the first door and the second door at respective ends of the first door and the second door opposite the first support wedge. This second step can include, in some embodiments, positioning a second platform of a second support platform pair of the second support wedge on the first door and positioning a first platform of the second support platform pair on the second door. The second platform of the second support platform pair can be at a greater elevation than the first platform of the second support platform pair relative to a first surface of the second support wedge. In some instances, this step can include seating the first and second doors at the second support wedge such that the respective handles of the first and second doors net over the adjacent door.

In a further exemplary embodiment, a third step can include placing a securing member (e.g., a strap, a band, etc.) around the first door and the second door. This step can include, in some instances, placing the securing member over a surface of the second support wedge at the top portion of the rack assembly that is opposite the surface of the second support wedge that defines the plurality of support platform pairs.

Although the present invention has been described with reference to certain disclosed embodiments, the disclosed embodiments are presented for purposes of illustration and not limitation and other embodiments of the invention are possible. A variety of related methods (e.g., methods of manufacturing, methods of installing, methods of using) are also within the scope of the present invention. One skilled in the art will appreciate that various changes, adaptations, and modifications may be made without departing from the spirit of the invention.

The invention claimed is:

1. A rack assembly comprising:

a support rack;

a first support wedge positioned at the support rack, the first support wedge having a first end, a second end opposite the first end, a first surface extending between the first end and the second end, and a second surface extending between the first end and the second end opposite the first surface, wherein the second surface defines a plurality of support platform pairs, each support platform pair including a first platform at a first elevation relative to the first surface and a second platform at a second elevation relative to the first surface, the second elevation being different than the first elevation; and a plurality of doors seated on the first support wedge, wherein the plurality of doors include a first door and a second door, the first door seated on the first platform and the second door seated on the second platform of one of the plurality of support platform pairs.

2. The rack assembly of claim 1, wherein the second elevation is greater than the first elevation.

3. The rack assembly of claim 2, wherein each support platform pair further includes a wall between the first platform and the second platform, and wherein the wall extends to a third elevation relative to the first surface, the third elevation being greater than the second elevation.

4. The rack assembly of claim 1, wherein the first end extends a first distance between the first surface and the second surface and the second end extends a second distance between the first surface and the second surface, the second distance being greater than the first distance.

5. The rack assembly of claim 4, wherein the plurality of support platform pairs include a first support platform pair and a second support platform pair, and wherein the first end extends to the first platform of the first support platform pair and the second end extends to the second platform of the second support platform pair.

6. The rack assembly of claim 4, wherein the first surface lies along a common elevation.

7. The rack assembly of claim 1, wherein the first end is at a first angle between ninety and one hundred and thirty five degrees relative to the first surface.

8. The rack assembly of claim 7, wherein the second end is at a second angle equal to the first angle relative to the first surface.

9. The rack assembly of claim 1, wherein the plurality of support platform pairs are spaced from one another along a length of the second surface.

10. The rack assembly of claim 9, wherein the plurality of support platform pairs include a first support platform pair and a second support platform pair, and wherein the second platform of the first support platform pair is adjacent the first platform of the second support platform pair.

11. The rack assembly of claim 1, wherein an end of the first door along which a handle is located is seated on the first platform, and wherein an end of the second door opposite an end of the second door along which a handle is located is seated on the second platform.

12. The rack assembly of claim 1, further comprising a second support wedge, the second support wedge having a third end, a fourth end opposite the third end, a third surface extending between the third end and the fourth end, and a fourth surface extending between the third end and the fourth end opposite the third surface, wherein the fourth surface defines a second plurality of support platform pairs, each support platform pair of the second plurality of support platform pairs including a third platform at a third elevation relative to the third surface and a fourth platform at a fourth elevation relative to the third surface, the fourth elevation being greater than the third elevation.

13. The rack assembly of claim 12, wherein the first door is seated on the fourth platform and the second door is seated on the third platform.

14. The rack assembly of claim 1, wherein the support rack comprises:

a base on which the first support wedge is positioned; and a backing brace secured to the base, the backing brace positioned at a third angle between ninety and one hundred and thirty five degrees relative to the base.

15. The rack assembly of claim 14, wherein the third angle at which the backing brace is positioned is equal to a first angle at which the first end is positioned relative to the first surface.

16. A support wedge comprising:

a first end;

a second end opposite the first end;

a first surface extending between the first end and the second end;

a second surface extending between the first end and the second end opposite the first surface, wherein the first end extends a first distance between the first surface and the second surface and the second end extends a second distance between the first surface and the second surface, the second distance being greater than the first distance; and a plurality of support platform pairs defined on the second surface, each support platform pair including a first platform at a first elevation relative to the first surface and a second platform at a second elevation relative to the first surface, the second elevation being greater than the first elevation.

17. The support wedge of claim 16, wherein each support platform pair further includes a wall between the first platform and the second platform, and wherein the wall extends to a third elevation relative to the first surface, the third elevation being greater than the second elevation.

18. The support wedge of claim 16, wherein the first end is at a first angle between ninety and one hundred and thirty five degrees relative to the first surface and the second end is at a second angle equal to the first angle relative to the first surface.

19. A support wedge comprising:

a first end;

a second end opposite the first end;

a first surface extending between the first end and the second end, wherein the first end is at an obtuse angle relative to the first surface;

a second surface extending between the first end and the second end opposite the first surface; and a plurality of support platform pairs defined at the second surface, each support platform pair including a first platform at a first elevation relative to the first surface and a second platform at a second elevation relative to the first surface, the second elevation being different than the first elevation.

20. The support wedge of claim 19, wherein each of the first platform and the second platform is disposed at the obtuse angle relative to the first surface.

* * * * *